US007329159B2

(12) United States Patent
Wilson et al.

(10) Patent No.: US 7,329,159 B2
(45) Date of Patent: Feb. 12, 2008

(54) SEAMED PIN FOR CRIMPING AND WELDING AS USED IN A FLUORESCENT LAMP

(75) Inventors: Carolyn E. Wilson, University Heights, OH (US); Frank Kozel, Solon, OH (US); Attila Szabo, Lewis Center, OH (US); Keith D. Brenton, Millford, CT (US); David D. Brenton, Oxford, CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/343,580

(22) Filed: Jan. 31, 2006

(65) Prior Publication Data

US 2006/0199446 A1 Sep. 7, 2006

Related U.S. Application Data

(63) Continuation of application No. 10/738,614, filed on Dec. 17, 2003, now abandoned.

(51) Int. Cl.
*H01R 13/02* (2006.01)

(52) U.S. Cl. ..... 439/884

(58) Field of Classification Search ..... 439/884, 439/612, 617, 618, 874, 236
See application file for complete search history.

(56) References Cited

U.S. PATENT DOCUMENTS

| | | | | |
|---|---|---|---|---|
| 2,680,236 | A | 6/1954 | Kuebler | |
| 4,015,165 | A | 3/1977 | Hardies | |
| 4,102,558 | A | 7/1978 | Krachman | |
| 4,878,854 | A | 11/1989 | Cannon | |
| 4,912,371 | A | 3/1990 | Hamilton | |
| 5,147,227 | A | 9/1992 | Yurko | |
| 6,846,013 | B2 * | 1/2005 | Smith | 280/740 |

* cited by examiner

*Primary Examiner*—Tulsidas C. Patel
*Assistant Examiner*—Phuongchi Nguyen
(74) *Attorney, Agent, or Firm*—Fay Sharpe LLP

(57) ABSTRACT

A universal pin includes a seam along its length. A necked-down region or small, constant diameter portion includes a wall of increased thickness that is conducive to both welding and crimping operations used to secure the lead wire to a pin in a fluorescent lamp assembly.

8 Claims, 4 Drawing Sheets

SEAMED PIN FOR CRIMPING AND WELDING AS USED IN A FLUORESCENT LAMP

This continuation application claims priority from U.S. Ser. No. 10/738,614, filed Dec. 17, 2003, now abandoned the disclosure of which is incorporated herein by reference.

BACKGROUND OF THE INVENTION

This disclosure relates to a pin, particularly an electrical pin used for crimping or in welding to make an electrical connection to another component. In particular, the invention relates to the design of a low cost, seamed pin that meets process, design, and industry standards for crimping and welding specifically associated with fluorescent lamps, although the invention may find use in related environments that encounter similar standards.

Heretofore, lamp manufacturers have used and continue to use two distinctly separate pins for linear fluorescent lamp bases. That is, one type of pin is manufactured for welding processes while a separate type of pin has been manufactured for crimping processes. That is, it is well known in the art that the cathode in a linear fluorescent lamp is supported by a pair of lead wires extending from a cathode located in an end of the lamp. It is necessary to connect these first and second lead wires to first and second pins, respectively, that extend outwardly from the lamp cap.

Once the lead wires are fed into a first or inner end of each pin, the crimping process deforms the pin inwardly into tight mechanical and electrical engagement with the lead wires. Crimp process pins are typically seamless, i.e., circumferentially continuous along their length. This structure is primarily due to an inability to design a seamed pin that was sufficiently strong to withstand crimping forces. A seamed pin often would cause issues relating to threading of the leads from the base lamp to the bases themselves. Unfortunately, this resulted in increased cost associated with the manufacture of such pins.

On the other hand, the welding process uses a necked-down or reduced diameter portion. This is contrasted with the crimp pin that typically does not have a necked-down portion. The necked-down or reduced diameter portion is required in welded pins to allow for good contact between the pin and the mating material. Thus, at high, automated manufacturing rates, the necked-down region is required so that effective welding can occur.

As a result, different manufacturing processes are required to form the different pin styles. In addition, it has been necessary to develop two processes for different manufacturing applications, and the inventory of one type of pin did not find particular application in the other process.

Thus, a need exists for an inexpensive electrical pin for use in either crimping or welding processes that establishes effective electrical connection with another component, e.g. a lead wire. It will be appreciated, however, that the pin design may have application outside of the lighting industry for use in other electrical applications. There is a further need to eliminate a complex set of multiple components, specific to different applications, while providing a competitive advantage on a per unit basis.

BRIEF DESCRIPTION OF THE INVENTION

An electrical pin comprises an elongated linear hollow body having a seam extending along a length thereof. A first end of the pin includes a first opening dimensioned to receive a lead wire therethrough. The second end includes a reduced dimension relative to the first end. A wall thickness at the reduced diameter second end is greater than the second end permitting the pin to be either crimped or welded to an associated lead wire received therethrough.

According to a preferred method of forming a seamed pin for use in one of welded and crimped arrangements, the method includes the steps of providing a generally planar stock material. The stock material is formed into a hollow tubular pin body. The material is drawn through a die and progressively formed from nose to tail. In a first stage, opposed edges are curled to form a generally cylindrical body. The feedstock is advanced the length of the finished component, and a first necked-down region formed at a first end. The feedstock is again incrementally advanced and a circumferentially continuous, radially extending shoulder is formed on the tube and the second end pressed inwardly. After advancing the feedstock again, the shoulder is rounded, the second end brought closer to the final dimension, and the first end necked-down while maintaining substantially the same wall thickness for the remainder of the tube. After advancing the strip to a final stage, the necked-down region is further swaged or deformed to provide a thick wall region.

A primary advantage of the invention is the ability to use the same type of pin in either the crimping or welding process.

Another advantage of the invention resides in reduced manufacturing costs, as well as reduced inventory costs.

Still another advantage of the invention relates to a less expensive manufacturing process for pins, particularly relative to a very expensive pin typically used for crimped fluorescent light bases.

Still other advantages and benefits of the invention will become more apparent to one skilled in the art upon reading and understanding the following detailed description.

DETAILED DESCRIPTION OF THE INVENTION

Figure 1:
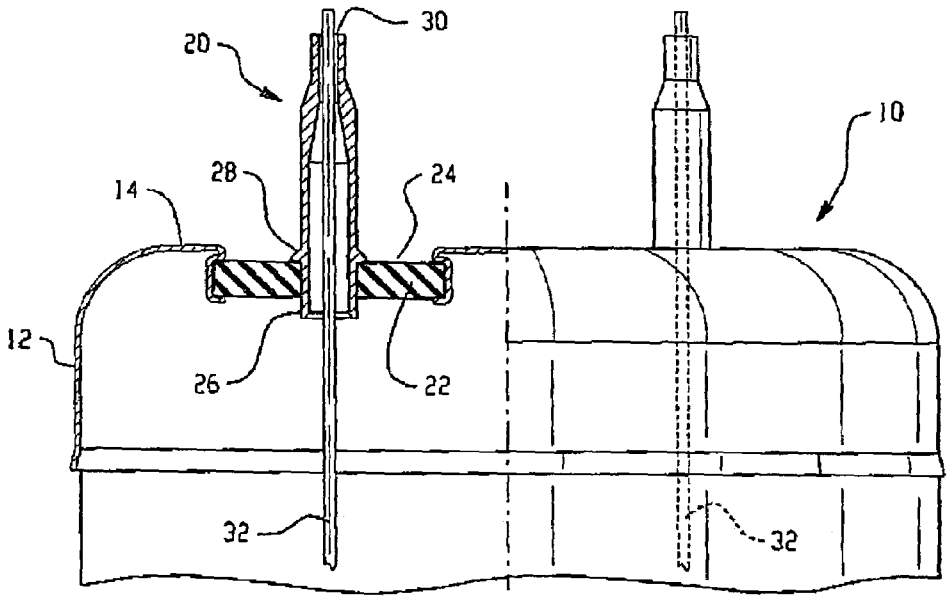
Fig. 1 PRIOR ART
FIG. 1 is an enlarged view, partially in cross-section, of an end cap as typically used in fluorescent lamp assemblies.

FIG. 1 illustrates an end cap 10 of a fluorescent lamp (not shown) comprised of a circumferentially continuous sidewall 12 and an end wall 14 through which first and second contacts or pins 20 extend. Such a bi-pin arrangement for establishing electrical and mechanical contact with an associated lamp fixture (not shown) is common in the art so that further discussion herein is deemed unnecessary to a full and complete understanding of the invention. In particular, each of the pins 20 is mechanically secured to an insulative material layer 22 received in a recess 24 of the end wall 14 of the cap. Each pin is mechanically secured to the insulative material via an enlarged diameter first end 26 that engages an underside or first surface of the material 22 and a radial shoulder 28 extending outwardly of the pin that engages an outer side or second surface of the insulative material. A central passage or through-opening 30 is provided through each pin and adapted to receive a lead wire schematically represented at 32 that extends from a cathode (not shown) housed in an inner cavity or discharge chamber of the fluorescent lamp. A terminal end of the lead wire 32 is mechanically and electrically engaged within the pin either by crimping or welding as noted in the Background portion of this disclosure.

Figure 2:
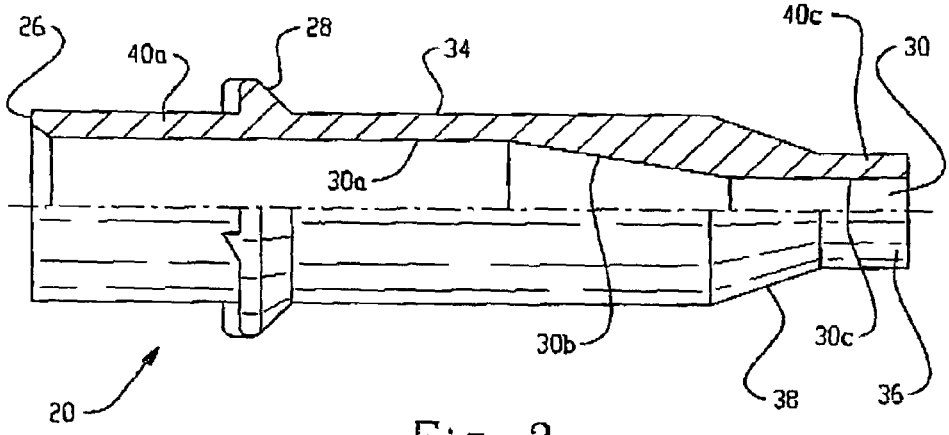
Fig. 2 PRIOR ART
FIG. 2 is an enlarged view, partially in cross-section, of the weld pin illustrated in FIG. 1.

With continued reference to FIG. 1, and as perhaps better seen in FIG. 2, a prior art weld pin is shown in greater detail. The pin 20 is shown prior to insertion or assembly in the end cap so that first end 26 is of substantially the same outer diameter as the remainder of external surface 34 of the elongated length of the pin. Shoulder 28 is axially spaced from the first end and a second end 36. The shoulder extends radially outward from the external surface of the pin where the shoulder is adapted for abutting engagement with the insulative material 22 as described with reference to FIG. 1. The second end 36 of the pin is a constant, reduced diameter portion that merges or interconnects with the remainder of the body through a tapered region 38. As is also apparent from the cross-sectional portion of the illustration, the through opening 30 is larger and substantially constant in this region, as represented by reference numeral 30*a*, as it proceeds from the first end 26 toward the tapered region. The pin then tapers inwardly at portion 30*b* that reduces the internal diameter to a smaller diameter where it ultimately merges with constant diameter portion 30*c*. As will be appreciated from FIG. 2, the external taper 38 and the internal tapered surface 30*b* are axially off-set. However, the constant diameter end 36 and constant diameter through-opening portion 30*c* define a wall thickness 40*c* at the second end that is substantially identical to wall thickness 40*a* at the first end.

As noted in the Background, it was necessary to form pins as a circumferentially continuous structure, i.e., no seam along its length, when the pin was intended for use in the crimping process. A pin with a seam has heretofore proved unworkable in enduring the forces imposed during the crimping operation. As a result, expensive machining operations to form a circumferentially continuous cylindrical pin have added undesired cost to the crimping process.

On the other hand, enough material must be removed from the weld end of the pin (a small, constant diameter portion is required) in order to make the pin effective in the welding process. Thus, although the prior art structure of FIG. 2 has proved commercially successful for the welding process, the weld pin was simply inadequate for crimping purposes for the reasons previously noted. Development of a universal pin therefore required a reduced external diameter 32, but with an increased wall thickness to also serve the crimping needs. Heretofore such manufacturing of a universal pin would have required extensive machining to provide a thicker wall portion 40*c*.

Figure 3:
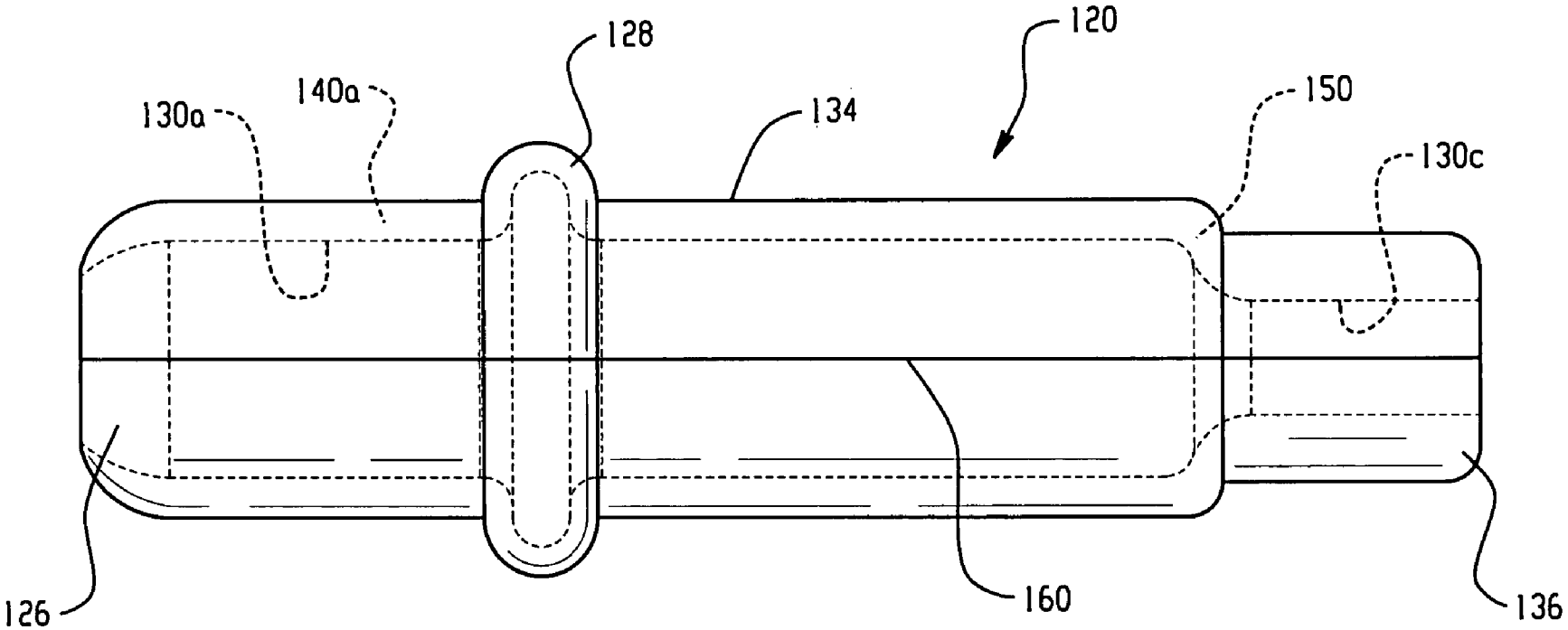
FIG. 3 is an enlarged elevational view of a pin formed in accordance with the present invention.

Turning now to FIG. 3, like components of the pin are identified by reference numerals increased by a factor of one hundred, e.g., pin 20 of the prior art of FIGS. 1 and 2 is compared with pin 120 in FIGS. 3-6 formed under the teachings of the present invention. A first or lead wire end 126 of the pin 120 is adapted to receive one of the lead wires extending from the cathode and lamp assembly (not shown). The first end includes a generally constant diameter external surface that encloses a constant diameter internal passage or through opening 130*a*. This results in a generally constant wall thickness 140*a* throughout this region of the pin. Shoulder 128 also proceeds radially outward from the remainder of the body, again, to aid in assembly of the pin to the end cap assembly. As will become more apparent from the detailed discussion below, the opening increases in diameter as the opening extends through the radial shoulder 128. This is primarily due to the method of manufacturing the pin. The remainder of the body proceeds along the generally constant external diameter 134 and opening internal diameter 130*a*.

A more abrupt transition is provided between the enlarged diameter first end with the second end 136 in the pin of FIGS. 3-6. Particularly, the transition from the generally constant diameter opening 130*a* to the smaller diameter opening 130*c* is achieved through a generally constant wall thickness 150. This is a noticeable difference, and an improvement over the prior arrangement. A substantially thicker wall is provided that allows the seam 160 to endure external crimping forces imposed on the small diameter portion 136. Moreover, the constant diameter portion 136 has a sufficiently reduced external sidewall diameter that is effective for subsequent high speed automation welding of the pin.

Figure 4:
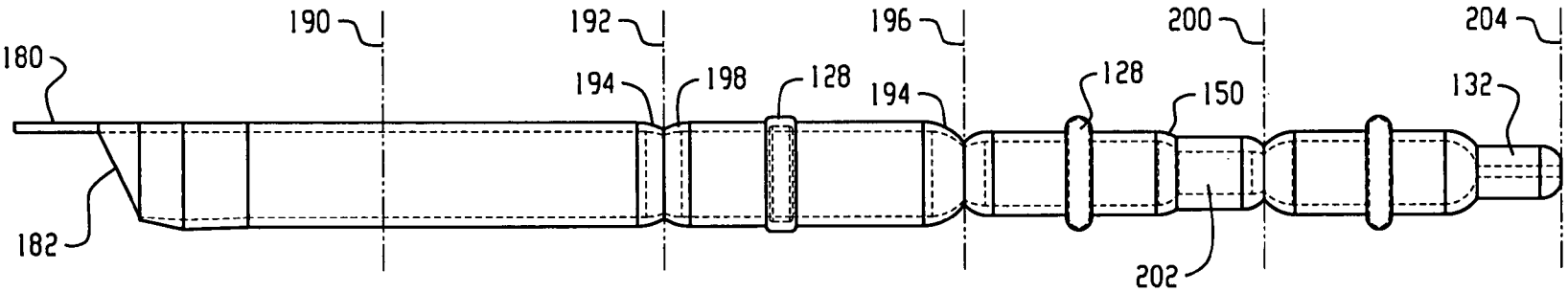
FIG. 4 is an elevational view of a strip of material being successively formed into a pin.
Figure 5:
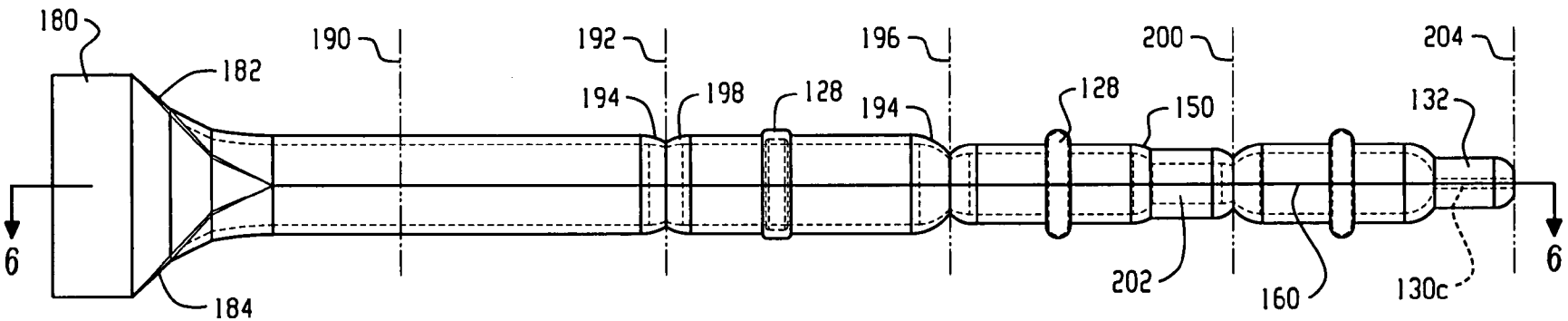
FIG. 5 is a bottom view of the strip of FIG. 4.
Figure 6:
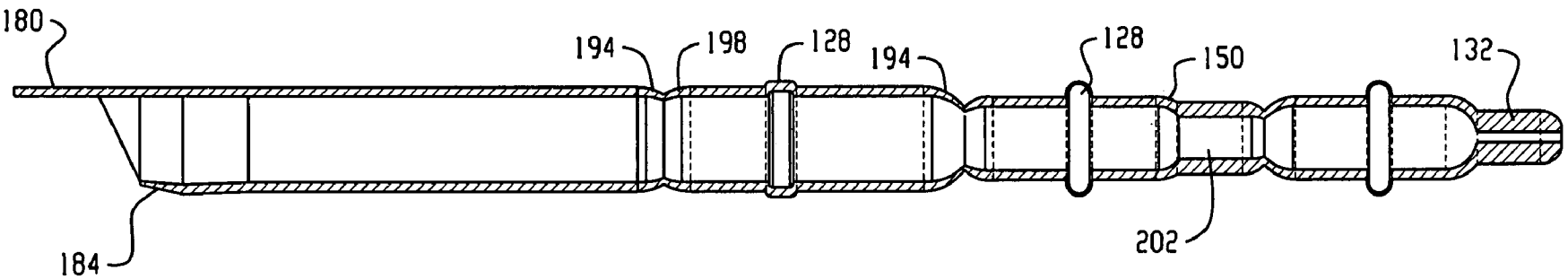
FIG. 6 is a longitudinal cross-sectional view of the strip of FIG. 5, taken generally along the lines 6-6 of FIG. 5.

Rather than machining such a complex shape, FIGS. 4-6 illustrate a preferred process of metal deformation achieved during a progressive die formation. Particularly, a coil of flat stock material 180 is fed to a progressive die set. The die (not shown) opens and draws the feedstock 180 therein. Opposed edges 182, 184 are deformed or curled over an internal mandrel (not shown) to form tight edges of seam 160 in the final construction. Thus, in the first stage, a draw die or tooling moves relative to the length of the part, i.e., to a stage represented by reference numeral 190. The tooling in this stage forms the initial cylindrical conformation of the pin with the longitudinally extending seam 160. In a second stage of progressive formation, i.e., between stages 190 and 192, the cylindrical conformation is complete and the tooling forms a first pinch or reduction 194 in the end of the pin. The continuous strip is then advanced the length of the part, i.e., advanced from stage 192 to 196, where the tooling in this forming step begins initial formation of shoulder 128. In addition, the tooling begins further forms the end 194 and a reduction in the second end as identified by reference numeral 198 in FIG. 6. The diameter of the main portion of the body remains substantially the same as does the wall thickness. In the fourth stage, i.e., between stages 196 and 200, additional external and internal formation of the shoulder 128 is completed. More importantly, the overall external and internal diameter of the pin along the body is reduced as shown, and transition portion 150 is formed to merge with the initial reduction identified by reference numeral 202 in the crimp or weld end of the pin. Some increased wall thickness is also exhibited in this area.

In the next stage of formation, between stages 200 and 204, the wall thickness 132 is significantly increased by the tooling while the internal diameter 130*c* is formed in the small diameter end. Thus, as will be appreciated, by the time the feedstock is advanced in multiple increments toward the right-hand end, the seamed pin includes a reduced, constant diameter portion 132 with a thickened wall section and a small diameter opening 130*c* therethrough. Because the forming process involves a series of progressive formation steps and deforming of material in a die assembly, the cost to manufacture is substantially reduced relative to alternative arrangements. That is, although the final configuration illustrated in FIG. 3 could also be reproduced through various machining operations, the progressive die formation allows feedstock to be quickly, effectively, and efficiently transferred through progressive die steps to achieve the small diameter, thick wall portion at the weld/crimp end of the pin. In the final stage, the completed pin is separated from the remainder of the feedstock.

By using a forming process that forms/rolls the feedstock into a pin so that there is very little upset along the seam, high quality pins are formed. Moreover, by virtue of the necked-down end design, the pin is able to endure the force subsequently applied by a crimping tool. The necked-down design also allows use of the same pin for welding. Previously, weld pins had a necked-down region, while crimped pins did not. The neck-down is required in welding pins to allow for good contact from the pin to the mating material. The present design allows a cheaper manufacturing process for pins, as well as to commonize pins used for welding and crimping. This design also allows use of a single pin for all applications, resulting in a uniform base for all bi-pin applications for fluorescent lamps of these types. Since the crimping process creates a dimple on the surface of the pin and squeezes the lead wire disposed inside the pin diameter, it is important that the end be able to endure the crimp force. The outer end must also neck-down to enable a good weld of the lead to the pin. Uniquely, the present design incorporates both items.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A pin for use in a fluorescent lamp comprising:

an elongated, linear hollow body having a seam extending along a longitudinal length thereof, a first end portion having a first diameter and including a first opening along the longitudinal extent thereof and dimensioned to receive a lead wire therethrough, and a second end portion having a second diameter and including a second opening along the longitudinal extent thereof axially aligned with the first opening, wherein the first diameter is greater than the second diameter; and said hollow body defining a wall thickness along the longitudinal length thereof, the wall thickness along the second end portion being substantially greater than along the first end portion allowing the pin to be one of crimped and welded to an associated lead wire received therethrough, and wherein the transition between the lesser wall thickness and the greater wall thickness occurs abruptly at the transition from the first end portion to the second end portion.

2. The pin of claim 1 wherein the wall thickness along the first end portion is substantially constant.

3. The pin of claim 1 further including a circumferentially continuous radial shoulder on an external surface of the pin along the first end portion.

4. A pin for use in a fluorescent lamp comprising:

an elongated, linear hollow body having a seam extending along a longitudinal length thereof, a first end including a first opening dimensioned to receive a lead wire therethrough, and a second end axially spaced from the first end having a reduced dimension relative to the first end and having a reduced dimension, second opening relative to and communicating with the first end along an internal passage;

the body including an interconnecting portion, the interconnecting portion axially disposed between the first and second ends, the interconnecting portion having an external surface that transitions abruptly between a first portion having a generally constant cross-sectional first dimension adjacent the first end and a second portion having a generally constant second cross-sectional second dimension adjacent the second end; and a wall thickness of the body being greater at the second end than the first end allowing the pin to be one of crimped and welded to an associated lead wire received therethrough.

5. The invention of claim 4 wherein the interconnecting portion includes an inner surface transitioning between the first and second openings.

6. The invention of claim 4 wherein the cross sectional first dimension is larger than the cross sectional second dimension.

7. The invention of claim 4 wherein the transition from the first portion to the second portion being achieved through a generally constant wall thickness.

8. The invention of claim 4 further comprising a circumferentially continuous radial shoulder on an external surface of the pin between the first and second ends.

* * * * *